US010896683B2

(12) United States Patent
Craven et al.

(10) Patent No.: US 10,896,683 B2
(45) Date of Patent: Jan. 19, 2021

(54) LOSSLESS BANDSPLITTING AND BANDJOINING USING ALLPASS FILTERS

(71) Applicants: Peter Graham Craven, Surrey (GB); Malcolm Law, West Sussex (GB)

(72) Inventors: Peter Graham Craven, Surrey (GB); Malcolm Law, West Sussex (GB)

(73) Assignee: MQA Limited, London (GB)

( * ) Notice: Subject to any disclaimer, the term of this patent is extended or adjusted under 35 U.S.C. 154(b) by 0 days.

(21) Appl. No.: 16/064,886

(22) PCT Filed: Dec. 21, 2016

(86) PCT No.: PCT/GB2016/054030

§ 371 (c)(1),
(2) Date: Jun. 21, 2018

(87) PCT Pub. No.: WO2017/109495

PCT Pub. Date: Jun. 29, 2017

(65) Prior Publication Data

US 2019/0013032 A1 Jan. 10, 2019

(30) Foreign Application Priority Data

Dec. 21, 2015 (GB) ..... 1522560.0

(51) Int. Cl.
*G10L 19/00* (2013.01)
*G10L 19/24* (2013.01)
(Continued)

(52) U.S. Cl.
CPC ..... *G10L 19/0017* (2013.01); *G10L 19/008* (2013.01); *G10L 19/0204* (2013.01); *G10L 19/038* (2013.01); *G10L 19/24* (2013.01)

(58) Field of Classification Search
CPC ..... G10L 19/0017
See application file for complete search history.

(56) References Cited

U.S. PATENT DOCUMENTS

2007/0016417 A1* 1/2007 Sung ..... G10L 19/035 704/230
2008/0154584 A1* 6/2008 Andersen ..... G10L 19/005 704/211

(Continued)

FOREIGN PATENT DOCUMENTS

GB 2503110 A 12/2013
WO 96/37048 A2 11/1996
WO 2014/096236 A2 6/2014

OTHER PUBLICATIONS

"Combined Search and Examination Report under Sections 17 and 18(3)" for GB Application No. GB1522560.0 dated Jun. 29, 2017, 5 pp.

(Continued)

*Primary Examiner* — Douglas Godbold
(74) *Attorney, Agent, or Firm* — Buckley, Maschoff & Talwalkar LLC

(57) ABSTRACT

Methods and devices are described for lossless bandsplitting and bandjoining of streams of signal samples using allpass filtering. The bandsplitting operation reformats an original stream into two intermediate streams representing even and odd samples of the original stream, and then matrix filters these to provide two output substreams representing higher frequency components and lower frequency components of the original stream. Conversely, the bandjoining operation matrix filters two subband streams to provide two quantised intermediate substreams, and then interleaves the filtered streams to furnish an output stream, such that the intermediate substreams are the even and odd samples of the output stream.

31 Claims, 6 Drawing Sheets

(51) Int. Cl.

| | |
|---|---|
| ***G10L 19/008*** | (2013.01) |
| ***G10L 19/02*** | (2013.01) |
| ***G10L 19/038*** | (2013.01) |

(56) References Cited

U.S. PATENT DOCUMENTS

| | | | | |
|---|---|---|---|---|
| 2010/0318349 | A1* | 12/2010 | Kovesi | G10L 19/005 704/207 |
| 2015/0255078 | A1* | 9/2015 | Beack | G10L 19/008 704/500 |
| 2015/0279378 | A1* | 10/2015 | Craven | G10L 19/018 704/500 |
| 2016/0042744 | A1* | 2/2016 | Klejsa | G10L 19/028 704/230 |

OTHER PUBLICATIONS

"International Search Report and Written Opinion" for PCT Application No. PCT/GB2016/054030 dated Mar. 28, 2017, 11 pp.

Kleinmann et al. "Efficient Design of Low Delay IIR QMF Banks for Speech Subband Coding", 1996 8th European Signal Processing Conference, IEEE, Sep. 10, 1996, 4 pp.

Shyu et al., "A new approach to the design of complex all-pass IIR digital filters", Signal Processing, Elsevier Science Publishers, vol. 40, No. 2-3, Nov. 1, 1994, 10 pp.

"Communication pursuant to Article 94(3) EPC—Examination Report", dated Sep. 13, 2019 (dated Sep. 13, 2019), European Patent Office, for EP Application No. 16826760.7-1210, 4 pp.

Japanese Office Action dated Sep. 23, 2020 which was issued in a counterpart application.

Kleinmann, Thomas et al., Efficient design of low delay IIR QMF Banks for speech subband coding, 1996 8th European Signal Processing Conference (EUSIPCO 1996), IEEE, Sep. 10, 1996, pp. 1-4 Previously cited in an IDS filed on Jun. 21, 2018.

Kleinmann, Thomas et al., Low delay IIR QMF Banks with high perceptive quality for speech processing, 1996 IEEE International Conference on Acoustic Speech and Signal Processing Conference, IEEE, May 9, 1996, pp. 259-262.

* cited by examiner

LOSSLESS BANDSPLITTING AND BANDJOINING USING ALLPASS FILTERS

CROSS-REFERENCE TO RELATED APPLICATIONS

This application is a U.S. National Stage filing under 35 U.S.C. § 371 and 35 U.S.C § 119, based on and claiming priority to PCT/GB2016/054030 for "LOSSLESS BANDSPLITTING AND BANDJOINING USING ALLPASS FILTERS" filed Dec. 21, 2016 and claiming priority to GB Application No. 1225560.0 filed Dec. 21, 2015.

FIELD OF THE INVENTION

The invention relates to the processing of sampled signals, and particularly to lossless bandsplitting and bandjoining of such signals.

BACKGROUND TO THE INVENTION

Many applications require a sampled signal to be split into two or more frequency bands to produce subband signals that can be processed or transmitted separately at a lower sampling rate, followed by recombination to produce signal at the full sampling rate. Polyphase filtering networks (including Quadrature Mirror Filters) to perform the splitting and joining have been the subject of extensive research. Signal artefacts potentially introduced by bandsplit methods include passband ripple and aliasing, but designs are known in which the ripple is zero and in which, for transmission applications where the subband signals are presented unmodified to a final bandjoining filter, alias products that exist in the subband signals are cancelled in the final recombination.

The term lossless' is often used in the communications literature to refer to such designs, but in such literature perfect arithmetic is assumed and the designs so labelled may or may not provide exact reconstruction in the presence of arithmetic rounding errors. In this document we shall adopt terminology of the audio literature, wherein 'lossless' implies exact bit-for-bit reconstruction of signals that are already quantised. Thus, a lossless decoder must reverse any arithmetic errors or quantisations that are produced by an encoder.

'Lifting' techniques have frequently been used to implement lossless processing, and bandsplitting/joining architectures that use lifting have been described by A. R. Calderbank, I. Daubechies, W. Sweldens, and B-L. Yeo, "Wavelet Transforms That Map Integers to Integers", Applied And Computational Harmonic Analysis 5, 332-369 (1998) with particular reference to FIGS. 4 and 5 therein. For an encoder to split a sampled signal into a low frequency (LF) and a high frequency band (HF) and then for a corresponding decoder to join the bands, such architectures generally require that the encoder and the decoder each implement two finite impulse response (FIR) filters. The filters may be inconveniently long, each needing a number of taps inversely proportional to the width the transition between the LF and HF bands. Also, a 2-FIR design does not provide LF and HF responses that are mirror-images about the half-Nyquist frequency, as to achieve greater symmetry requires at least three FIR filters each in the encoder and decoder.

Another type of bandsplitting and joining in the communications literature uses IIR filtering. IIR filters can generally achieve higher slopes with a given number of arithmetic operations than can FIR filters, but the IIR band splitting and joining filters in the literature do not achieve lossless reconstruction. For example, in Kleinmann T and Lacroix A, "Efficient Design of Low Delay IIR QMF Banks for Speech Subband Coding" in Proceedings of EUSIPCO-96 Eighth European Signal Processing Conference Trieste, Italy, 10-13 Sep. 1996, the reconstructed amplitude response is flat but the group delay increases in the vicinity of the crossover frequency. This scheme would thus not be lossless even if implemented without quantisation errors.

What is needed therefore is an economical IIR architecture that provides lossless reconstruction. For applications where an encoder transmits the LF and HF bands separately to a consumer product, it is particularly desirable to minimise the computational complexity of the decoder.

SUMMARY OF THE INVENTION

The invention in a first aspect provides method of splitting an original stream of quantised signal samples having an original sample rate into two output substreams of quantised signal samples having half the original sample rate, the two output substreams representing higher frequency components and lower frequency components of the original stream respectively, the method comprising the steps of:

- reformatting the original stream into two intermediate streams representing even and odd samples of the original stream respectively;
- filtering and matrixing the two intermediate streams to provide the two output substreams,
- wherein the step of filtering and matrixing comprises:
  - using a quantiser to produce a quantised signal having samples;
  - producing the quantised signal samples in reverse time order; and
  - producing the quantised signal samples in dependence on feedback derived from previously produced samples of the quantised signal; and
- wherein each output substream is related to each intermediate stream by a respective transfer function comprising maximum phase poles.

The feedback is used to create poles in the transfer function which allow good frequency discrimination with few coefficients. Making the poles maximum phase enhances the prior art of Kleinmann and Lacroix by allowing a casual bandjoiner to remove the phase distortions. Operating on the samples in reverse order allows filtering with maximum phase poles to be stably implemented.

Preferably, for any output substream, the transfer function from both intermediate substreams have the same DC gain magnitude. In this way the use of a sum and difference matrix ensures that the bandsplitter directs DC purely to one output and Nyquist frequencies purely to the other.

In some embodiments, the step of matrix filtering comprises

- processing overlapping blocks of samples of the two intermediate streams;
- discarding a final portion of each processed block of samples corresponding to an overlap with another block; and
- combining the remaining portions of each processed block of samples.

In this way, the bandsplitter according to the invention can process the audio in overall forwards order, whilst operating locally on time reversed blocks. The overlap and discard allows for transients caused when processing of each block starts to have dissipated before reaching the section that affects the bandsplitter outputs.

Preferably, the two output substreams together contain the information required to allow the original quantised stream to be recovered exactly by a suitably initialised bandjoiner.

In this way, the operation can be exactly inverted allowing a system involving bandsplit, lossless transmission of each band, bandjoin to be lossless overall.

It is preferred that no two distinct input streams produce both the same output substreams and residual state in the filters.

In this way, no information about the signal samples is lost in the operation of the bandsplitter because each possible set of outputs is produced by at most one stream of input. Consequently, the bandsplitter can be described as lossless. Filter state needs including in the comparison because filtering spreads the effect of the input in time.

In some embodiments, the step of filtering and matrixing comprises:

filtering the two intermediate streams to produce two filtered intermediate streams; and matrixing the filtered intermediate streams to produce the two output substreams.

In this way, an implementation can use two filtering operations with simple matrixing for greater implementation efficiency. The tradeoff may sometimes run the other way however with low order allpass filters.

Preferably, the matrixing is performed using a sum and difference matrix.

Preferably, the output substreams are derived from the quantised signal by invertible linear processing with no further quantisation.

In this way, the bandsplitter can operate with only one quantisation in the signal path with lower quantisation noise on the bandsplitter outputs.

Since the feedback is derived from the quantisation, if follows that a subsequent process may unambiguously determine the quantised signal, and hence the feedback, from the output substreams. Knowledge of the feedback is important in order that state variables in a bandjoiner can accurately track those in a bandsplitter.

The invention in a second aspect provides a bandsplitter adapted to perform the method of the first aspect.

The invention in a third aspect provides a recorded medium containing data derived in dependence on a high frequency output and on a low frequency output of a bandsplitter according to the second aspect.

In this way, the recorded medium can cater both for consumers who use the bandjoiner to reconstruct a replica of the full bandwidth audio and consumers who do not who enjoy the reduced bandwidth audio.

The invention in a fourth aspect provides a method of joining two subband streams of quantised signal samples each having a subband sample rate, the method furnishing an output stream of quantised signal samples having twice the subband sample rate, the output stream having higher frequency components and lower frequency components represented by the two subband streams respectively, the method comprising the steps of:

matrixing and filtering the two subband streams to provide two quantised intermediate substreams; and, interleaving the two quantised intermediate to furnish the output stream, such that the intermediate substreams are respectively the even and odd samples of the output stream, wherein each intermediate substream is related to each subband stream by a respective transfer function that is infinite impulse response 'IIR' comprising maximum phase zeros; and wherein the step of matrixing and filtering incorporates quantisation configured to ensure that the output stream contains the information required to allow the quantised signal samples of each subband stream to be recovered exactly by a suitably initialised bandsplitter.

In this way, the operation of prior art Kleinmann and Lacroix's bandjoiner is enhanced to ensure it can exactly invert the operation of a bandsplitter according to the invention. Firstly the phase distortion of their prior art bandsplitter bandjoiner combination is removed. Secondly, subband streams produced by a bandsplitter according to the invention inevitably contain quantisation noise but appropriate quantisation within the bandjoining method cancels the noise introduced by the bandsplitting quantisation instead of adding further noise.

Preferably, for any subband stream, the transfer function to both intermediate streams has the same DC gain magnitude. In this way the use of a sum and difference matrix ensures that DC in the output comes purely from one input and Nyquist frequencies purely from the other.

For clarity, we note that if the operation of a bandjoiner can be inverted by a subsequent bandsplitter then the operation of the bandsplitter will also be inverted by the same bandjoiner placed subsequently to the bandsplitter.

In some embodiments the step of matrixing and filtering the two subband streams comprises:

matrixing the two subband streams to produce two matrixed substreams; and, filtering the two matrixed substreams with two different quantised filters respectively to produce the two quantised intermediate substreams In this way, an implementation can use simple matrixing and two filtering operations for greater implementation efficiency. The tradeoff may sometimes run the other way however with low order allpass filters.

In some embodiments the step of matrixing incorporates quantisation. This operates to invert less preferred bandsplitter embodiments where the matrixing is performed after filtering and incorporates further quantisation.

Preferably, the quantisation included within the signal processing loop is performed by a vector quantiser.

In this way, the bandjoiner can losslessly invert the operation of the preferable bandsplitter embodiments whose output substreams are derived from the quantised signal with no further quantisation.

Preferably, the steps of filtering are characterised by two different allpass responses.

In this way, the bandsplitter discrimination is derived from the extent to which the two allpasses exhibit a differential phase shift of 90 degrees. This leads to effective discrimination with few coefficients.

In some embodiments a first allpass response has coefficients of 1.0 and within $2^{-15}$ of 0.527864045 and a second allpass response has coefficients of 1.0 and within $2^{-15}$ of 0.105572809.

In some embodiments a first allpass response has coefficients of 1.0, within $2^{-15}$ of 0.3644245374 and within $2^{-15}$ of 0.01036373471 and a second allpass response has coefficients of 1.0, within $2^{-15}$ of 0.8365625224 and within $2^{0.15}$ of 0.09327361235.

In these ways, bandsplitter transfer functions without ripple are achieved from first or second order allpasses, appropriate for applications where the bandsplit audio will be listened to. Actual implementations will need to round the non-unit coefficients, a tolerance of $2^{-15}$ corresponds to rounding to a common coefficient size of 16 signed bits.

The invention in a fifth aspect provides a bandsplitter comprising:

an input adapted to receive an input stream of signal samples at a sample rate;

two outputs adapted to furnish two output streams, each output stream having half the sampling rate of the input stream;

a de-interleaving unit having an input and two outputs, wherein the input of the de-interleaving unit is coupled to the input of the bandsplitter and wherein the outputs of the de-interleaving unit contain even-numbered and odd-numbered samples of the input stream respectively;

two allpass filters each having a first input and an output;

a lossless sum-and-difference unit having two inputs and two outputs, wherein each of the inputs to the sum-and-difference unit is coupled to a respective one of the outputs of the two allpass filters, and wherein each of the outputs of the sum-and-difference unit is coupled to a respective one of the outputs of the bandsplitter;

wherein the allpass filters are adapted to receive the samples of the input stream in reverse time order.

In this way, operation by taking sums and differences of allpass filters allows good discrimination to be achieved with few coefficients. The reverse time order operation allows allpass filters with maximum phase poles to be stably implemented. These can be inverted by a casual allpass filter with minimum phase poles in a corresponding bandjoiner so that no phase or amplitude errors arise from splitting into bands.

In some embodiments the bandsplitter comprises also a quantiser wherein each allpass filter is adapted to furnish an output sample equal to the quantised sum of a previously received sample of the input stream and a linear combination of previously furnished output samples and samples of the input stream received subsequently to said previously sample of the input stream up to and including the current sample.

Preferably, each allpass filter has a second input adapted to receive feedback derived from the outputs of the sum-and-difference unit, the sum-and-difference unit thereby being integrated within the filter.

In this way, the bandsplitter can operate with only one quantisation in the signal path, allowing for the bandsplitter outputs to be lower noise approximations to the high and low frequency components of the original signal respectively.

Preferably, the bandsplitter comprises also a quantiser wherein each allpass filter is adapted to furnish an output sample equal to the quantised sum of a previously received sample of the input stream and a linear combination of feedback samples previously received by the second input of the allpass filter and samples of the input stream received subsequently to said previously received sample of the input stream up to and including the current sample.

In some embodiments one of the two filters is characterised by an infinite impulse response 'IIR' response having coefficients 340/32768 and 11941/32768 and the other allpass filter is characterised by an IIR response having coefficients 3056/32768 and 27412/32768.

In this way, coefficients are used for second order allpasses that approximate bandsplitter transfer functions without ripple. These values are rounded for fixed point implementation with 16 bit coefficients.

In a preferred embodiment, the bandsplitter comprises:

a blocking unit having an input and an output; and, a combining unit having an input, wherein the blocking unit is adapted to receive a stream of samples presented to its input, to divide the stream into overlapping blocks of samples where each block has a beginning and an end and to furnish the overlapping blocks at its output;

wherein the output of the blocking unit is coupled to the first inputs of the allpass filters;

wherein the allpass filters are adapted to process in reverse time order the samples within each overlapping block of samples and to furnish processed blocks of samples at their outputs;

wherein the outputs of the allpass filters are coupled to the input of the combining unit; and, wherein the combining unit is adapted to receive overlapping processed blocks of samples presented to its input, to discard from each processed block the overlapping portion from the end of processed block and to combine the remaining portions to furnish a continuous stream of processed samples.

In this way, each block of samples is processed in reverse time allowing the maximum phase poles to be stably implemented. However successive blocks can be processed in normal order, allowing the bandsplit to proceed with finite lookahead. The overlap and discard gives time for transients caused as the bandsplitter starts up on each block to disperse before processing samples which contribute to the output. Due to the reverse time processing these transients occur at the end of each block.

The invention in a sixth aspect provides a bandjoiner comprising:

two inputs adapted to receive a first and a second stream of input quantised signal samples;

an output adapted to furnish an output stream having a sampling rate twice that of each input stream;

a sum-and-difference unit having two inputs and two outputs configured respectively as a sum output and a difference output;

two allpass filters each having an first input and an output; and, an interleaving unit having two inputs and an output, wherein the inputs of the sum-and-difference unit are connected to the inputs of the bandjoiner;

wherein the first input of each of the two allpass filters is connected to, respectively, the sum output and the difference output of the sum-and-difference unit;

wherein the inputs of the interleaving unit are coupled to the outputs of the allpass filter; and, wherein the output of the interleaving unit is coupled to the output of the bandjoiner, wherein the bandjoiner is lossless.

In this way, the lossless characteristic enhances the operation of Kleinmann and Lacroix's bandjoiner by allowing a system consisting of a bandjoiner according to the invention and bandsplitter according to the invention to exactly replicate the input to the bandjoiner. Thus not only is the phase distortion of Kleinmann and Lacroix removed but also the noise introduced by the bandsplitter's quantisations is removed by the bandjoiner's quantisations.

In some embodiments, the sum-and-difference scales one of its inputs by a factor 2 before taking the sum and difference.

In this way the sum and difference matrix can accommodate a factor of two difference in gain on the two inputs, arising from a bandsplitter using a unit determinant sum and difference unit.

Preferably, the bandjoiner comprises also a quantiser wherein each allpass filter is adapted to furnish an output equal to a quantised sum of a sample previously received by the first input and a linear combination of previously furnished output samples and input samples received subsequently to said previously received sample up to and including the current sample.

Preferably, the quantiser is a vector quantiser adapted to jointly quantise signals within both allpass filters.

In this way, the bandjoiner can invert the operation of a bandjoiner operating in the preferable lower noise mode with a single quantisation instead of separate quantisations in the matrixing and filtering.

Preferably, the bandjoiner comprises a vector quantiser having two inputs and two and two outputs, wherein the inputs of the vector quantiser are connected to the respective outputs of the two allpass filters;

wherein the outputs of the vector quantiser are connected to the outputs of the bandjoiner;

wherein each allpass filter has a second input adapted to receive feedback derived in dependence on the outputs of the vector quantiser.

Preferably, the bandjoiner comprises also a quantiser wherein each allpass filter is adapted to furnish an output equal to a quantised sum of a sample previously received by the first input and a linear combination of previously furnished samples of the feedback and input samples received subsequently to said previously received sample up to and including the current sample.

Preferably, the bandjoiner is configured to process pairs of signals produced by a bandsplitter such that the output of the bandjoiner is a lossless replica of a stream of signal samples that was received by the bandsplitter.

In this way, the lossless operation of the bandjoiner is evident providing the advantages of no phase distortion and no net quantisation noise outlined above.

Preferably, the bandjoiner contains allpass filters having state variables such that if the bandjoiner is operated twice to furnish a first output stream and a second output stream, with identical initialisation of the state variables but with a difference in the input streams received on the two occasions, then either there will be a difference between the first output stream and the second output stream or there will be a difference between the states of the filters after each operation.

In this way, it is established that the bandjoiner does not lose information since distinct inputs are still distinguishable after operation and thus is lossless.

In some embodiments a first allpass filter is characterised by an IIR response having coefficients 340/32768 and 11941/32768 and a second allpass filter is characterised by an IIR response having coefficients 3056/32768 and 27412/32768.

In this way, coefficients are used for second order allpasses that approximate bandsplitter transfer functions without ripple. These values are rounded for fixed point implementation with 16 bit coefficients.

The invention in a seventh aspect provides a transmission system comprising an encoder comprising a lossless bandsplitter and a decoder comprising a lossless bandjoiner, wherein the bandsplitter and bandjoiner each contain an allpass filter comprising a dithered quantiser, wherein the transmission system also provides synchronised dither for a quantiser in the bandsplitter and a quantiser in the bandjoiner.

In this way, the quantisations in the bandsplitter benefit from the use of dither whilst the synchronisation preserves the lossless behaviour of the combined system. Those quantisations are audible if the bandsplit signal is listened to directly.

As will be appreciated by those skilled in the art, the present invention provides techniques and devices for lossless bandsplitting and bandjoining of sampled signals that provide for lossless reconstruction. Further variations and embellishments will become apparent to the skilled person in light of this disclosure.

BRIEF DESCRIPTION OF THE DRAWINGS

Examples of the present invention will be described in detail with reference to the accompanying drawings, in which.

DETAILED DESCRIPTION

Allpass with Time-Reverse

Figure 1:
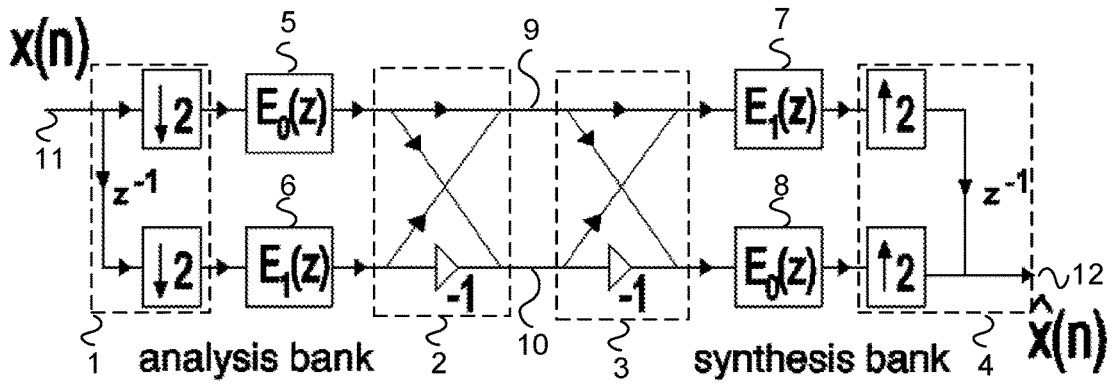
FIG. 1 illustrates a known lossy IIR bandsplitter and bandjoiner.

The prior-art structure of FIG. 1, reproduced from the above-mentioned paper by Kleinmann and Lacroix, is designed to split the incoming sampled signal 11 into two sub-band signals 9 and 10 sampled at half the original rate, and then to recombine them to furnish the output signal 12. Typically, the sub-band signal 9 is an IF' signal containing predominantly low-frequency information from the input signal 11 while the sub-band signal 10 is an 'HF' signal containing predominantly high-frequency information from the input signal 11.

We note that the sum-and-difference unit 3 inverts the effect of sum-and-difference unit 2, save for an overall scaling by a factor 2. Units 2 and 3 could be identical. The operation of FIG. 1 can thus be described as:

The signal 11 is split into even and odd sample streams by the de-interleave unit 1.

The even samples are filtered by filter 5 having transfer function $E_0$ and the odd samples by filter 6 having transfer function $E_1$.

The two sum-and-difference units 2 and 3 together have a null effect save for scaling by 2.

The even samples are now filtered by filter 7 having transfer function $E_1$ and the odd samples by filter 8 having transfer function $E_0$.

The even and odd sample streams are recombined in the interleaving unit 4.

Thus, the even samples from the de-interleaving unit have been filtered by $E_0$ then by $E_1$ while the odd samples have been filtered by $E_1$ then by $E_0$. Since filtering is commutative it is evident that the effect of FIG. 1 in total is to scale the stream 11 by a factor 2 in amplitude and to filter it with transfer function $E_0 \cdot E_1$. There is also a delay of one sample caused by the $z^{-1}$ elements in the de-interleaving and interleaving units.

If filters 5 and 6 were straight-through paths, i.e. if $E_0=1$ and $E_1=1$, then signal 10 would have zero response to zero-frequency signal components of the input 11 and similarly signal 9 would have zero response to original signal components at the Nyquist frequency, i.e. half the sampling frequency of the signal 11. Thus very low and very high frequencies would have been separated. Other frequencies are incompletely separated because of the frequency dependent phase shift produced by the "$z^{-1}$" delay within the de-interleaving unit. It is the purpose of the filters 5 and 6 to compensate approximately this phase shift so that good discrimination between high and low frequencies is maintained over a significant bandwidth.

Thus the response $E_0$ should provide at low frequencies a phase shift relative to that of $E_1$ that approximates a delay of one sample period of the signal 11. Because $E_0$ and $E_1$ are implemented at half the original sample frequency, they must therefore be designed as a pair of allpass filters whose phase difference approximates one half sample period at the local sampling frequency. We shall exhibit suitable designs shortly but firstly we need to address the problem that the combination of bandsplitter and bandjoiner shown in FIG. 1 has a transfer function $(E_0 \cdot E_1)$ which is allpass and therefore introduces phase distortion. This problem is acknowledged in the Kleinmann and Lacroix paper referred to above but in telecommunications practice some residual phase distortion is considered acceptable and a fully lossless solution has not been sought.

Conceptually, the unwanted transfer function $(E_0 \cdot E_1)$ can be corrected using an inverse filter $(E_0 \cdot E_1)^{-1}$. Ignoring for the moment the significant practical difficulty that this inverse filter is acausal, in FIG. 2 we merge a conceptual inverse filter $(E_0 \cdot E_1)^{-1}$ into filters 5' and 6', which now have conceptual responses $E_1^{-1}$ and $E_0^{-1}$ respectively.

Design procedures suitable for generating pairs of allpass filters whose sums and differences provide Butterworth, Chebyshev or elliptic responses are given in: P. P. Vaidyanathan, S. K. Mitra and Y. Neuvo, "A New Approach to the Realization of Low Sensitivity IIR Digital Filters", IEEE Trans. on Acoustics, Speech and Signal Processing, vol. ASSP-34, no. 2, pp. 350-361, April 1986.

For audio applications in which zero ripple is desirable and in which sharp corners are undesirable, we have found the following filters suitable:

First order:

$$E_0 = \frac{z^{-1} + 0.5278640450}{1 + 0.5278640450\, z^{-1}}$$

-continued $$E_1 = \frac{z^{-1} + 0.1055728090}{1 + 0.1055728090\, z^{-1}}$$

Second order:

$$E_0 = \frac{z^{-2} + 0.3644245374\, z^{-1} + 0.01036373471}{1 + 0.3644245374\, z^{-1} + 0.01036373471\, z^{-2}}$$

$$E_1 = \frac{z^{-2} + 0.8365625224\, z^{-1} + 0.0932736124}{1 + 0.8365625224\, z^{-1} + 0.0932736124\, z^{-2}}$$

Here and subsequently within this document, $z^{-1}$ represents a delay of one sample at the sub-band sample rate: this is appropriate for implementation but different from the convention used by Kleinmann and Lacroix.

Inserting a scale factor of ½, the lowpass and highpass responses are given by:

$$\text{lopass}=(E_1^{-1}+E_0^{-1})/2 \quad \text{hipass}=(E_1^{-1}-E_0^{-1})/2$$

It is well known that the time-reverse of an allpass filter is also its inverse. This can be verified for example by substituting z for $z^{-1}$ in the expression for $E_0$ above, which has the same effect as interchanging numerator and denominator.

We note that reverse-time processing is not necessarily impractical. In some consumer applications, an encoder separates an audio signal into LF and HF components, these being conveyed separately and combined in the consumer's decoder. Pre-encoding of an audio track is normally performed as a file-to-file process, so reverse-time processing is not conceptually more difficult than forwards processing. Hence the acausal allpass filters $E_1^{-1}$ and $E_0^{-1}$ can be implemented as causal filters in reverse time:

$$\text{lopass}=\text{Rev}(E_1+E_0)/2 \quad \text{hipass}=\text{Rev}(E_1-E_0)/2$$

Figure 3:
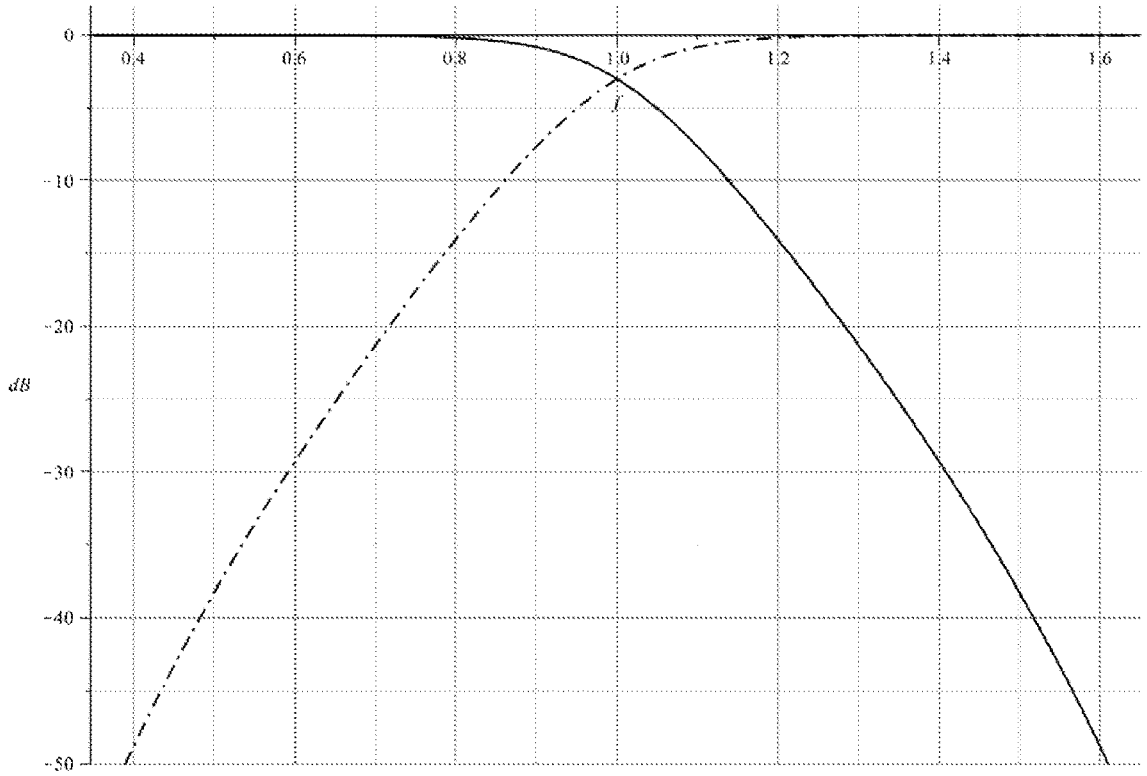
FIG. 3 shows the amplitude response of a 1st order HR bandsplitter, where the solid trace is the LF signal and the dot-dash trace is the HF signal.
Figure 4:
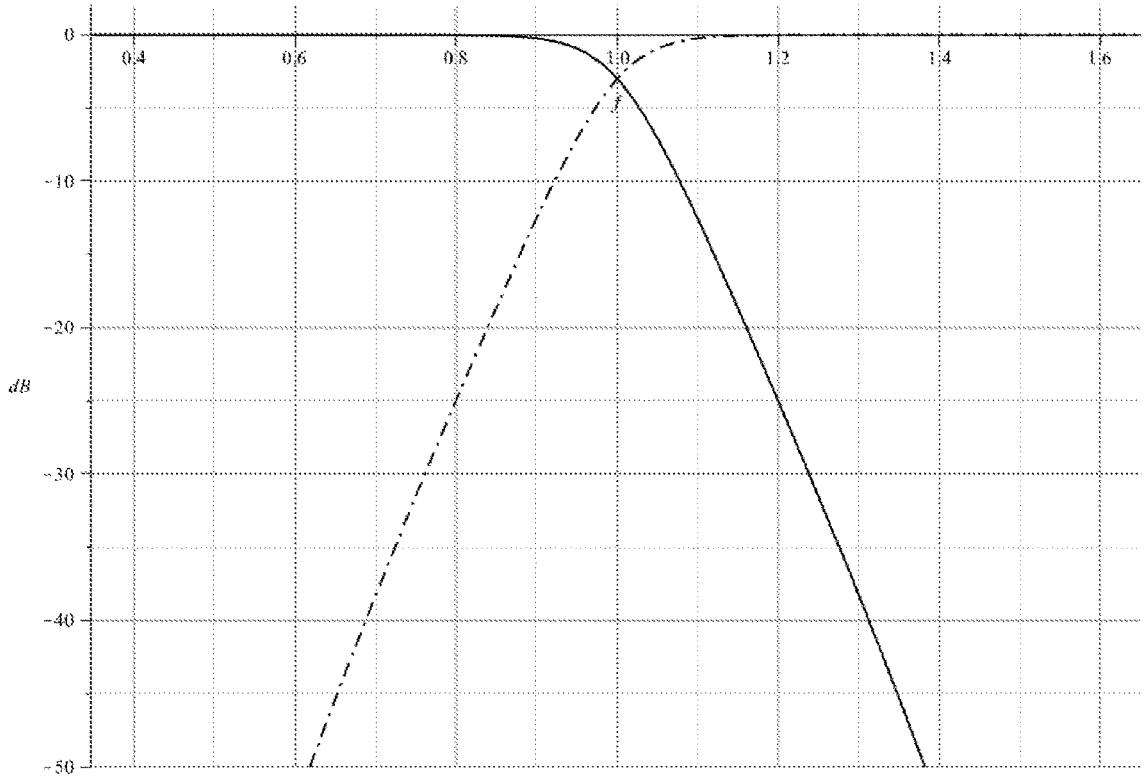
FIG. 4 shows the amplitude response of a 2nd order IIR bandsplitter, where the solid trace is the LF signal and the dot-dash trace is the HF signal.

The resulting lowpass and hipass responses are shown in FIG. 3 for the first order filter and in FIG. 4 for the second order filter. Frequency is scaled so f=1 is the crossover frequency, which equals the subband Nyquist frequency, and f=2 is the original Nyquist frequency. The design preserves total power and the lowpass and hipass curves are symmetrical about f=1, where each is −3 dB. The first order hipass in FIG. 3 attenuates by 38 dB at f=0.5 and by 70 dB at f=0.25. The second order hipass in FIG. 4 attenuates by 69 dB at f=0.5 and by 126 dB at f=0.25. These attenuations may be considered remarkable in view of the low computational cost of these designs.

With suitable initialisation, the above prescription would provide for exact reconstruction by a bandjoiner of a signal presented to a bandsplitter, assuming exact arithmetic throughout. We now review how filtering can be made lossless when using quantised arithmetic.

Lossless Minimum-Phase IIR Filtering

Figure 5A:
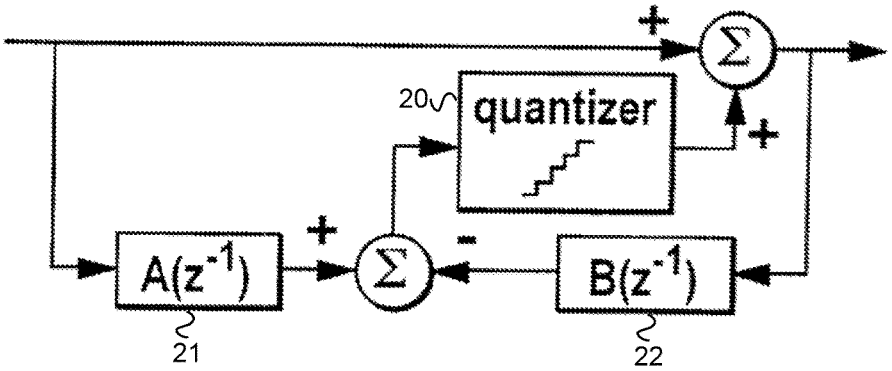
FIG. 5A shows a known lossless IIR filter architecture.

The popular "Direct form I" implementation of a minimum-phase IIR filter is easily made lossless, as was indicated in WO 96/37048 "Lossless Coding Method for Waveform Data". FIGS. 6*c* and 6*d* from that document are reproduced here as FIG. 5A and FIG. 5B respectively. Other figures from that document show several other topologies having the same or similar functionality. FIG. 5A shows a first order lossless HR filter having a z-transform of $(1+A(z^{-1}))/(1+B(z^{-1}))$, whereas FIG. 5B shows the corresponding inverse filter having a z-transform of $(1+B(z^{-1}))/(1+A(z^{-1}))$.

The input to FIG. 5A is assumed to be quantised with a certain step size and the quantiser 20 quantises to the same step size, thus ensuring that the output is similarly quantised. The coefficients of filters 21 and 22 have finite wordlengths and the quantiser 20 also prevents recirculating signals from acquiring arbitrarily long wordlengths through repeated multiplication by the fractional coefficients in filter 22.

Figure 5B:
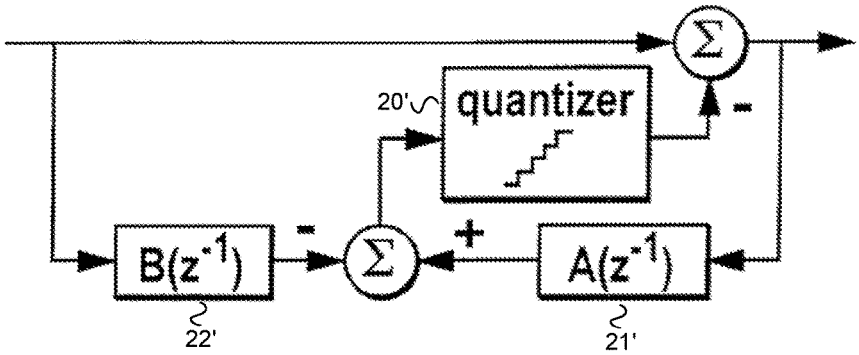
FIG. 5B shows the inverse of the filter shown in FIG. 5A.

The operation of FIG. 5A is deterministic, and as explained in WO 96/37048, a cascade of FIG. 5A and FIG. 5B will regenerate at the output of FIG. 5B an exact replica of the input to FIG. 5A, assuming the input is already quantised and assuming that the state variables in the filters 21' and 22' are initialised to the same values as those of filters 21 and 22. In some designs this initialisation is performed explicitly, while others rely on probabilistic convergence between the states of the two filters, accepting that the regeneration will not be lossless unless and until such convergence has been obtained.

Reverse-Time Implementation of Acausal IIR Filters

We now show in more detail how the first order allpass filter $E_0$ and its inverse $E_0^{-1}$ may be implemented, where:

$$E_0 = \frac{z^{-1} + 0.5278640450}{1 + 0.5278640450\, z^{-1}}$$

$$E_0^{-1} = \frac{1 + 0.5278640450\, z^{-1}}{z^{-1} + 0.5278640450}$$

or more compactly:

$$E_0 = \frac{z^{-1} + k}{1 + z^{-1}k}$$

$$E_0^{-1} = \frac{1 + z^{-1}k}{z^{-1} + k}$$

where k=0.527864045 and in particular $|k|<1$, which ensures that the denominator of $E_0$ is minimum-phase and $E_0$ is thereby a stable and causal filter that can be implemented by standard means.

We consider the LF path of an encoding-decoding application in which an input sequence of sample values $\{x_i\}$ is presented to $E_0^{-1}$ in an encoder to produce a transmitted sequence $\{y_i\}$, which in turn is presented to $E_0$ in a decoder. We require that the output of $E_0$ be the identical input sequence $\{x_i\}$, as expressed in the recurrence relation:

$$x_i = y_{i-1} + y_i k - x_{i-1} k,\ i = 1 \ldots n$$

To deduce the operation of the $E_0^{-1}$ filter in the encoder, we solve for $y_{i-1}$:

$$y_{i-1} = x_i - y_i k + x_{i-1} k,\ i = n \ldots 1$$

Causality requires the computation of the values $\{y_i\}$ to be performed in order of decreasing i, as indicated by the notation i=n . . . 1 and reflecting the reverse time implementation of filter $E_0^{-1}$. To initialise the computations the encoder needs a value for $y_n$ as well as the given signal values $\{x_i, i=1 \ldots n\}$. $y_n$ may be chosen arbitrarily, for example zero. The decoder also needs initialisation, a convenient method being for the encoder to transmit the original value $x_1$ along with the filtered values $\{y_i, i=1 \ldots n\}$. The decoder then uses $x_1$ directly as its first output value as well as using it as state initialisation for the remaining computations which run from i=2 onwards.

Given such initialisation the decoder is then able to reconstruct exactly the original signal $\{x_i\}$, subject only to arithmetic rounding errors and any wordlength truncation in transmission. An exactly similar procedure with k=0.1055728090 may be used to implement $E_1$ and $E_1^{-1}$.

Lossless Reverse-Time Processing

For lossless processing we assume a quantised input sequence $\{x_i\}$ and the results of multiplications by fractional coefficients must be quantised. The recurrence relations above are now replaced by:

$$x_i = y_{i-1} + Q_i(y_i k - x_{i-1} k),\ i = 1 \ldots n$$

where $Q_i$ represents quantisation with the same step size as the input sequence $\{x_i\}$. The transmitted sequence $\{y_i\}$ then also contains values quantised to the same step size. The suffix "i" in "$Q_i$" highlights that the quantisation Q may be different from one sample to another, as for example in a dithered quantiser. However in an encoder-decoder pair, each $Q_i$ in the encoder must be identical to the corresponding $Q_i$ in the decoder, which in the case of dither would normally be achieved by identical pseudorandom sequence generators, synchronised between encoder and decoder.

It is not required that the quantised values be integer multiples of a step size: sometimes it is advantageous to use a quantiser with a random offset as explained in co-pending patent application PCT/GB2015/050910. Other generalizations include that the signals $\{x_i\}$ and $\{y_i\}$ may be vector-valued, the $Q_i$ being vector quantisers.

Blockwise Reverse-Time Encoder Processing

In both the unquantised case and the lossless case, exact reconstruction of the complete output sequence $\{x_n\}$ requires initialisation of the decoder's state eg by the value $x_1$.

With unquantised processing using exact arithmetic, failure to provide correct initialisation causes a transient error proportional to the impulse response of $E_0$, which when $E_0$ is first order will be a decaying exponential and more generally a linear combination including damped sinewaves. This transient error will reduce rapidly as i increases and will normally become insignificant after a few samples or a few tens of samples.

With lossless' quantised processing, incorrect initialisation will cause a similar initial transient error. Once the transient has died down the error becomes noiselike unless and until the states of the decoding filter $E_0$ become synchronised with the states of the encoding. With filter of high order this state synchronisation may never happen, but for the filters $E_0$ of order 2 considered in this document and using appropriate dithered quantisers we have estimated there is a probability of less than $10^{-12}$ that synchronisation will not have been achieved after 120 sample periods from the time when the initial transient has died down and the error has become noiselike. For the second-order filters discussed here, an initial transient takes about 30 samples to decay by 96 dB or 45 samples to decay by 144 dB. It follows that these filters settle to a state independent of the initialisation after 165 sample periods with almost complete certainty.

This reasoning may now be applied to reverse-time filtering. If a block of 1165 samples taken from the start of a longer file is filtered in reverse time, the first 1000 filtered samples will thereby be the same, with almost complete certainty, as the first 1000 samples of the whole file when filtered in reverse time. It follows therefore that reverse-time filtering of the whole file is unnecessary: the file may be processed in blocks that overlap by at least 165 samples. The blocks may be processed in any order, in particular in forwards order or in parallel, reverse-time filtering being used within each block and the final 165 samples of each block being discarded. This principle also makes possible the live processing of a stream of samples, subject to a delay introduced by the block processing and overlap.

Figure 6:
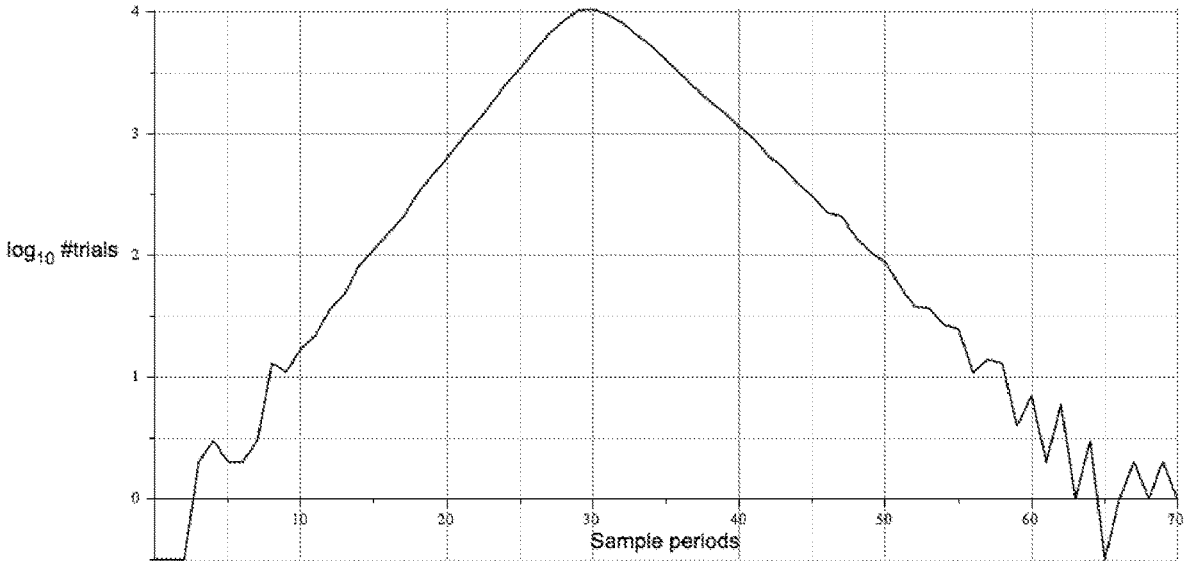
FIG. 6 shows a histogram of the time taken for a pair of randomly initialised lossless allpass filters to converge to the same state.

The estimates of 165 sample is based on an extrapolation of FIG. 6 which relates to 100,000 trials in which two quantised filters were initialised with states corresponding to different and randomly chosen signal values of order $2^{15}$ quantisation steps. The filters were second order with coefficients k1=0.8365625224 and k2=0.09327361235 as given earlier, and their respective quantisers were dithered with the same 'RPDF' dither having a rectangular probability density function and a peak-to-peak amplitude equal to one quantisation step. FIG. 6 is a histogram of the time taken for the two quantisers to come into alignment. The vertical axis is the logarithm to base 10 of the number of trials and the horizontal axis is time in sample periods. It will be seen that on most trials the quantisers take about 30 sample periods to synchronise and that the number that have not synchronised reduces by about a factor 10 for each ten sample periods thereafter.

Second Order Recurrence Relations

For reference the recurrence relations presented previously are extended to second order filtering. Taking $E_0$ as an example, the numeric expression:

$$E_0 = \frac{z^{-2} + 0.3644245374z^{-1} + 0.01036373471}{1 + 0.3644245374z^{-1} + 0.01036373471z^{-2}}$$

can be expressed as:

$$E_0 = \frac{z^{-2} + z^{-1}k_1 + k_2}{1 + z^{-1}k_1 + z^{-2}k_2}$$

where $k_1$=0.3644245374 and $k_2$=0.01036373471.

The decoding and encoding equations are now:

$$x_i = y_{i-2} + Q_i(k_1y_{i-1} + k_2y_i - k_1x_{i-1} - k_2x_{i-2}),\ i=1 \ldots n$$

$$y_{i-2} = -Q_i(k_1y_{i-1} + k_2y_i - k_1x_{i-1} - k_2x_{i-2}) + x_i,\ i=n \ldots 1$$

corresponding to the conceptual filters $E_0$ and $E_0^{-1}$, respectively. The initialisation conditions for the encoder are that any convenient value, such as zero, may be used for the quantities $y_{n-1}$ and $y_n$, which are referred to but not computed. The encoder can initialise the decoder by transmitting the original values $x_i$ and $x_2$ along with the filtered values $\{y_i, i=1 \ldots n\}$. The decoder then uses $x_1$ and $x_2$ directly as its first two output values as well as using them as state initialisation for the remaining computations which run from i=3 onwards.

Initialisation may alternatively be omitted if correct reconstruction is not required for the first few tens of decoded samples.

Lossless Sum and Difference

Figure 2:
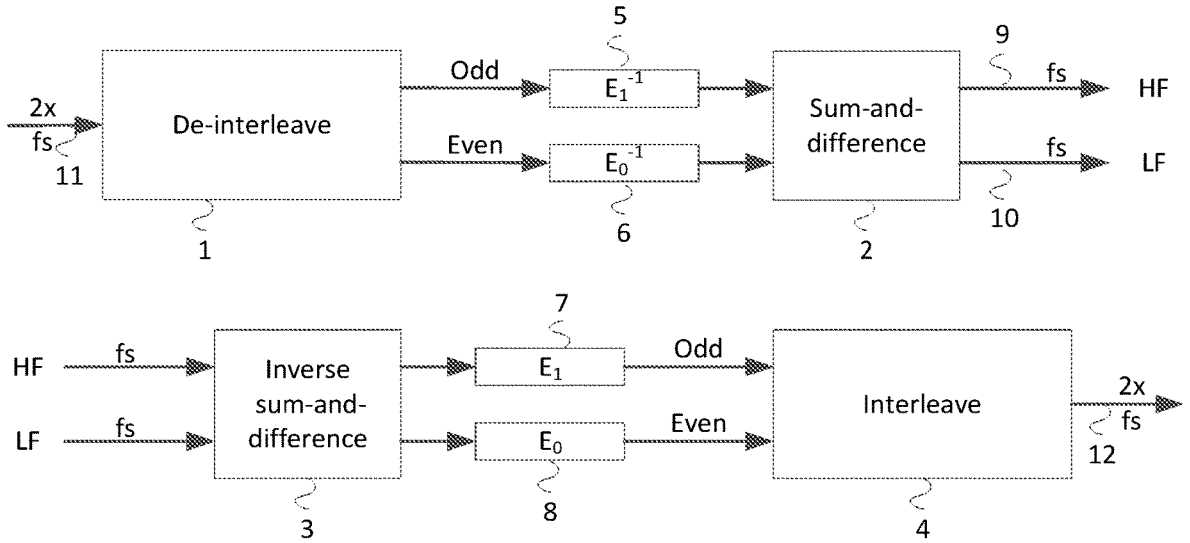
FIG. 2 illustrates the bandsplitter and bandjoiner of FIG. 1 with conceptual correction for phase distortion.

FIG. 2 shows a sum and difference network 2 in the bandsplitter and an inverse sum and difference network 3 in the bandjoiner. The bandsplitter and bandjoiner are redrawn in FIG. 7 and FIG. 8 to show the lossless allpass networks 16 incorporating the lossless allpass In the above discussion of implementing acausual filters we were content for the composition of units 2 and 3 to introduce a scaling of 2. When we move onto lossless operation however, this factor of 2 becomes awkward because we need the inputs to filters 7 and 8 to be exact lossless replicas of the outputs from filters 5' and 6'. We present a number of ways of dealing with this issue.

The most straightforward approach is to incorporate a scaling by 2 into unit 3 so that it is indeed an exact inverse of unit 2.

Thus unit 2 computes:

$$\begin{pmatrix} L \\ H \end{pmatrix} = \begin{pmatrix} 1 & -1 \\ 1 & 1 \end{pmatrix} \begin{pmatrix} E \\ O \end{pmatrix}$$

and unit 3 computes:

$$\begin{pmatrix} E \\ O \end{pmatrix} = \begin{pmatrix} 1 & -1 \\ 1 & 1 \end{pmatrix}^{-1} \begin{pmatrix} L \\ H \end{pmatrix} = \frac{1}{2}\begin{pmatrix} 1 & 1 \\ -1 & 1 \end{pmatrix} \begin{pmatrix} L \\ H \end{pmatrix}$$

which is a duplicate of unit 2 combined with a scaling by 0.5.

However this implementation is awkward to use as part of a system involving lossless compression of the Lf and Hf signals because when E and O are independently auantised values, L and H are not. Due to the transfer function $$\begin{pmatrix} 1 & -1 \\ 1 & 1 \end{pmatrix}$$

having determinant −2, there is mutual information in the L and H outputs (they have a common Isb), and any lossless compression would be inefficient if it did not exploit this redundancy. Yet having to exploit this curious redundancy is an onerous requirement to impose.

To avoid this issue, the sum and difference unit 2 preferably has determinant ±1, a sensible choice being sum and half difference, as follows:

$$\begin{pmatrix} L \\ H \end{pmatrix} = \begin{pmatrix} 1 & 1 \\ -0.5 & 0.5 \end{pmatrix} \begin{pmatrix} E \\ O \end{pmatrix}$$

And so unit 3 computes:

$$\begin{pmatrix} E \\ O \end{pmatrix} = \begin{pmatrix} 1 & 1 \\ -0.5 & 0.5 \end{pmatrix}^{-1} \begin{pmatrix} L \\ H \end{pmatrix} = \frac{1}{2}\begin{pmatrix} 0.5 & -1 \\ 0.5 & 1 \end{pmatrix} \begin{pmatrix} L \\ H \end{pmatrix}$$

The computation of 0.5(O−E) needs quantising, which introduces extra noise into the Hf output of the bandsplitter, but can be done in a lossless manner by:

$$L=E+O$$

$$H=O-Q(0.5L)$$

And the inverse operation for unit 3 is:

$$O=H+Q(0.5L)$$

$$E=L-O$$

Integration of Allpass with Lossless Sum and Difference

It is further possible to reduce the amount of quantisation noise in the Lf output by integrating the allpass filtering with the sum and differencing operations. This is particularly beneficial in a system such as described in WO2013186561 where the Lf output of the bandsplitter may be listened to by those who do not have access to bandwidth extension data. It also avoids the need for the extra quantisation in the Hf audio path.

Figure 7:
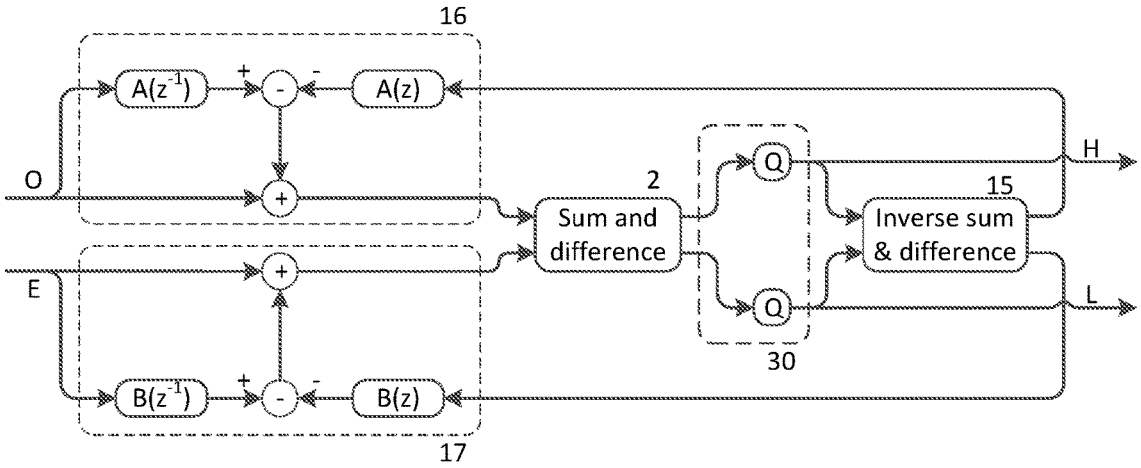
FIG. 7 illustrates a bandsplitter similar to that of FIG. 2 but with integration of the allpass filtering with the lossless sum and difference operations.
Figure 8:
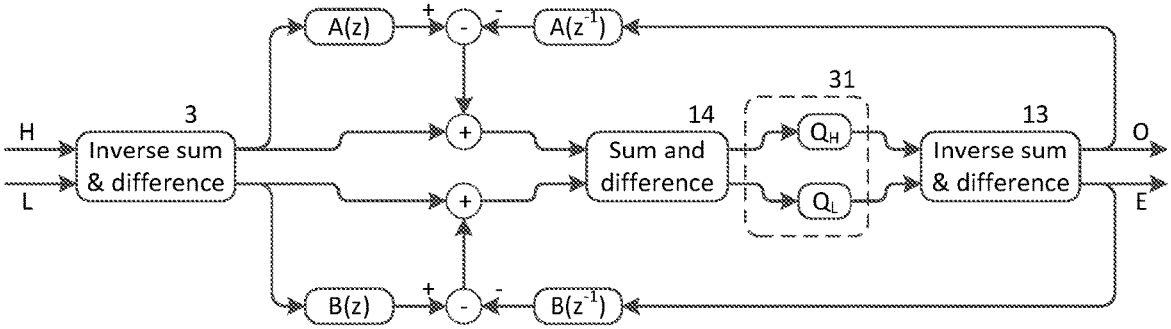
FIG. 8 illustrates a bandjoiner corresponding to the bandsplitter illustrated in FIG. 7.

This is illustrated in FIGS. 7 and 8, where sum and difference operations 2 and 14 are intended to be implemented by:

$$\begin{pmatrix} L \\ H \end{pmatrix} = \begin{pmatrix} 1 & 1 \\ -0.5 & 0.5 \end{pmatrix} \begin{pmatrix} E \\ O \end{pmatrix}$$

And the inverse sum and difference operations 3, 13 and 15 are intended to implement:

$$\begin{pmatrix} E \\ O \end{pmatrix} = \begin{pmatrix} 0.5 & -1 \\ 0.5 & 1 \end{pmatrix} \begin{pmatrix} L \\ H \end{pmatrix}$$

In contrast to the last section, these may now be performed with exact arithmetic.

FIG. 7 shows the reorganisation of 5', 6' and 2 in the bandsplitter. The filter 16 replaces 5', implementing the allpass $$\frac{1 + A(z^{-1})}{1 + A(z)} = E_1^{-1}$$

but the quantisation is deferred till after the sum and difference operation 2 and feedback is taken from after an extra inverse sum and difference operation 15. Likewise, filter 17 replaces 6'. The net effect of this is that a vector quantisation is performed inside both allpasses, so that the Lf and Hf signals are separately quantised.

FIG. 8 shows the operation of the bandjoiner. If FIG. 8 is fed the output of FIG. 7, operation 3 duplicates operation 15 in FIG. 7 ensuring that the inputs to filters A(z) and B(z) replicate their inputs in FIG. 7. If we assume that prior outputs of FIG. 8 have replicated the inputs to FIG. 7 and that quantisation 31 subtracts the same quantisation error as quantisation 30 added, then we can inductively conclude that FIG. 8 exactly inverts the operation of FIG. 7.

We now consider what conditions need to be satisfied for quantisers 31 to have the negated quantisation error of quantisers 30.

Firstly, consideration needs to be given to situations where two output values are equidistant from an input value. If the quantisers 30 round a tie towards $-\infty$ then quantisers 31 must round a tie towards $+\infty$. (This differs from the situation in FIGS. 5A and 5B because the bandjoiner quantisers are now in the main signal path rather than quantising side chain alterations).

Secondly, supposing the inputs and outputs of FIG. 7 are quantised to multiples of a stepsize Δ, then the same will be true of the outputs from FIG. 8. But they are derived from the outputs of quantiser 31 by an inverse sum and difference matrix such as $$\begin{pmatrix} E \\ O \end{pmatrix} = \begin{pmatrix} 0.5 & -1 \\ 0.5 & 1 \end{pmatrix} \begin{pmatrix} L \\ H \end{pmatrix} \text{ which rearranges to}$$

$$\begin{pmatrix} L \\ H \end{pmatrix} = \begin{pmatrix} 1 & 1 \\ -0.5 & 0.5 \end{pmatrix} \begin{pmatrix} E \\ O \end{pmatrix}$$

If E and O are both an even multiple of Δ or both an odd multiple of Δ then L will be an even multiple of Δ and H will be a multiple of Δ. But if E and O are have opposite parity, then L will be an odd multiple of Δ and H will be an odd multiple of Δ/2.

So the bandjoiner of FIG. 8 needs to quantise L first, and then depending on whether L is even or odd quantise H to either a multiple of Δ or a multiple of Δ plus Δ/2 respectively.

Figure 9A:
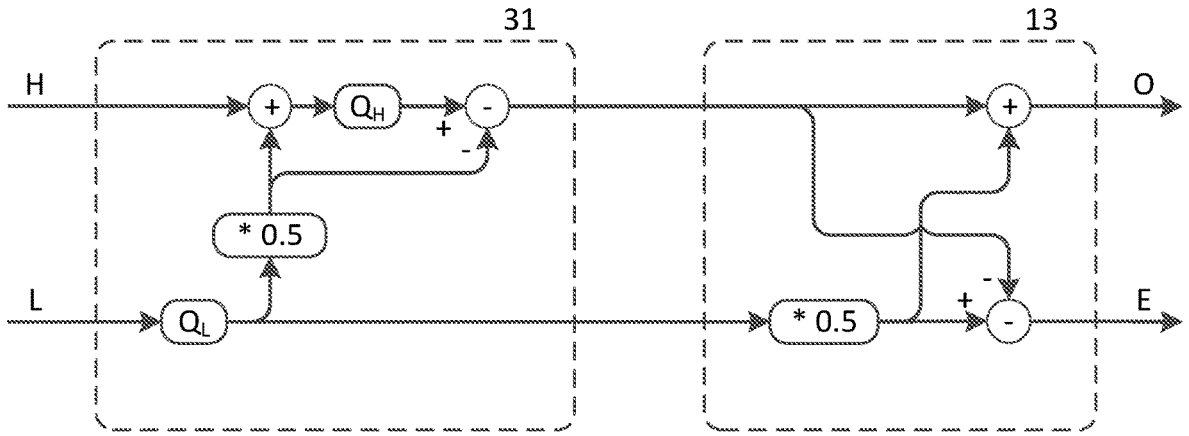
FIG. 9A illustrates an expansion of operations 31 and 13 of the bandjoiner shown in FIG. 8.

One way of doing this is to add half the quantised value of L before using a quantiser which quantises to integer values of Δ for $Q_H$ and then subtract it again afterwards. This expansion of operation 31 is shown in FIG. 9A which also expands the following operation 13 implementing the inverse sum and difference $$\begin{pmatrix} E \\ O \end{pmatrix} = \begin{pmatrix} 0.5 & -1 \\ 0.5 & 1 \end{pmatrix} \begin{pmatrix} L \\ H \end{pmatrix}.$$

Figure 9B:
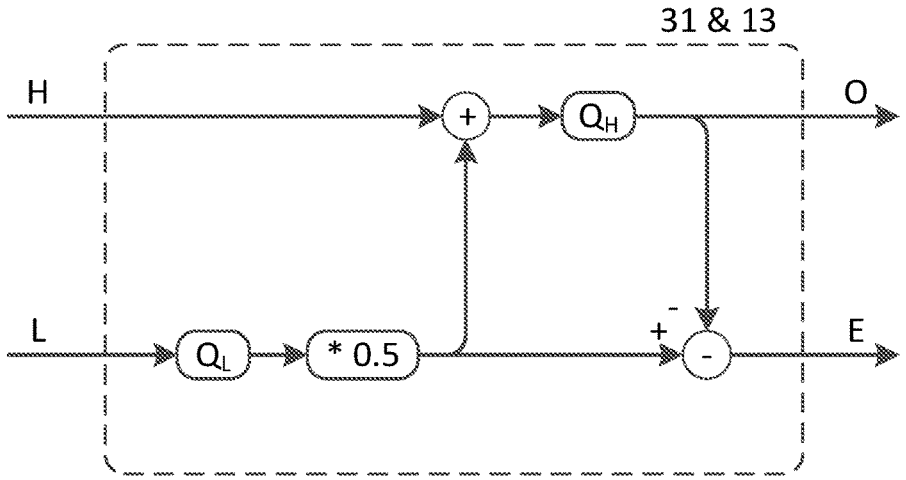
FIG. 9B shows a simplified version of the combined operations shown in FIG. 9A.

The operation in 13 of adding 0.5L cancels the operation in H of subtracting it and the combined operation simplifies as shown in FIG. 9B.

Figure 10:
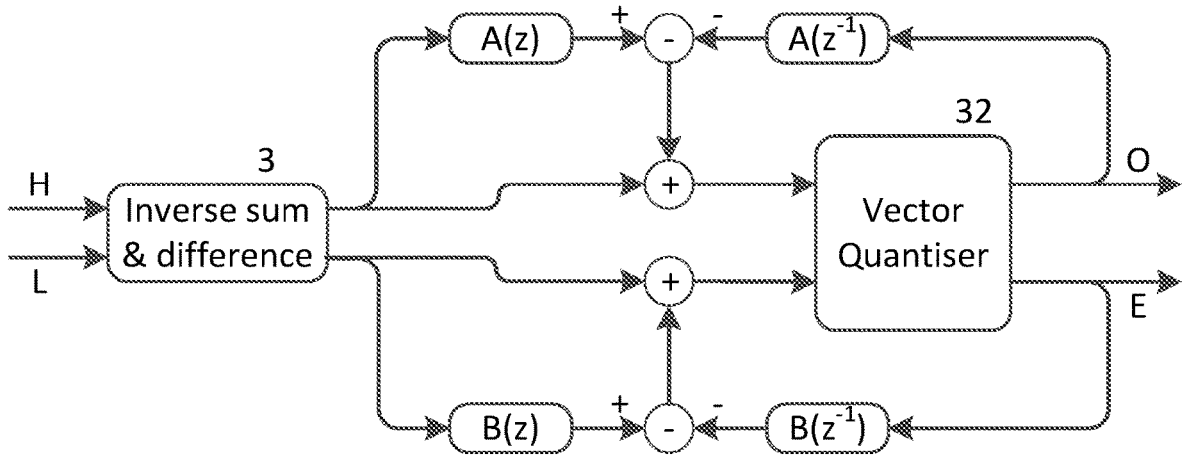
FIG. 10 illustrates an vector quantiser representation of operations performed by the bandjoiner shown in FIG. 8.
Figure 11:
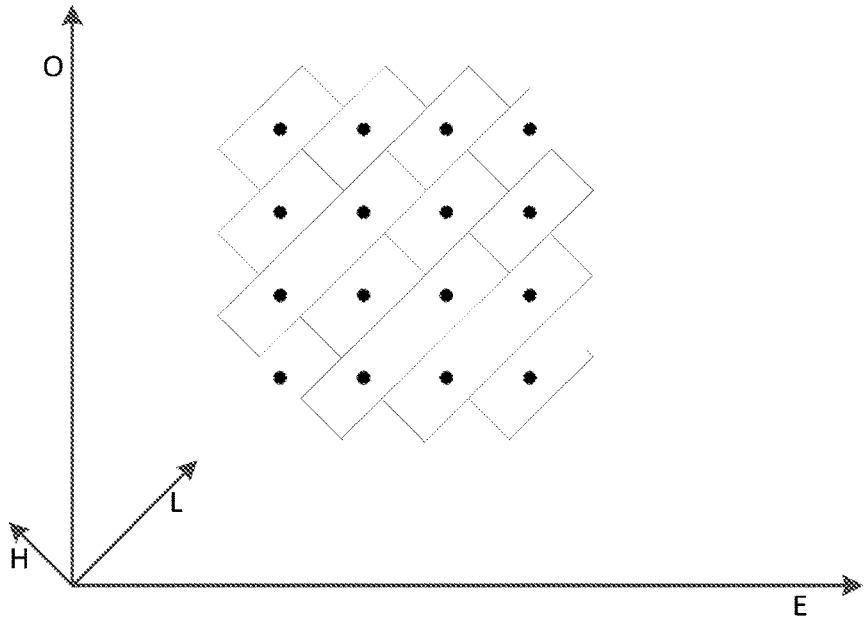
FIG. 11 illustrates the quantisation implemented by the vector quantiser shown in FIG. 10.

An alternative perspective illustrated in FIG. 10 is that operations 14, 31 and 13 in FIG. 8 form a vector quantiser 32 implementing the quantisation illustrated in FIG. 11. The dots are the quantised outputs in EO space. The diagonal rectangles are the regions quantised to each output value. The L and H axes are also shown, and with respect to these axes the quantisation regions are square and axis aligned. But alternate L rows are offset forming a brickwork pattern.

Arithmetic Variations

It will be appreciated that there are numerous ways to rearrange the arithmetic without affecting the essence of the invention.

For example. FIG. 8 expresses the signal path from the input to the quantiser inputs as:

$$\begin{pmatrix} Q_L^{in} \\ Q_H^{in} \end{pmatrix} = \begin{pmatrix} 1 & 1 \\ -0.5 & 0.5 \end{pmatrix} \begin{pmatrix} 1 + A(z) & 0 \\ 0 & 1 + B(z) \end{pmatrix} \begin{pmatrix} 0.5 & -1 \\ 0.5 & 1 \end{pmatrix} \begin{pmatrix} L \\ H \end{pmatrix}$$

This multiplies out to $$\begin{pmatrix} Q_L^{in} \\ Q_H^{in} \end{pmatrix} = \begin{pmatrix} 1 + 0.5(A(z) + B(z)) & B(z) - A(z) \\ 0.25(B(z) - A(z)) & 1 + 0.5(A(z) + B(z)) \end{pmatrix} \begin{pmatrix} L \\ H \end{pmatrix}$$

2 filters with sum and difference operations, have been transformed into 4 filters with related coefficients on all 4 paths between L/H and $Q_L^{in}/Q_H^{in}$. Clearly the essence of the invention is unchanged by such transformations.

The invention claimed is:

1. A method of splitting an original stream of quantised signal samples having an original sample rate into two output substreams of quantised signal samples having half the original sample rate, the two output substreams representing higher frequency components and lower frequency components of the original stream respectively, the method comprising the steps of:

reformatting the original stream into two intermediate streams representing even and odd samples of the original stream respectively;

filtering and matrixing the two intermediate streams to provide the two output substreams, wherein the step of filtering and matrixing comprises:

using a quantiser to produce a quantised signal having samples;

producing the quantised signal samples in reverse time order; and producing the quantised signal samples in dependence on feedback derived from previously produced samples of the quantised signal; and wherein each output substream is related to each intermediate stream by a respective transfer function comprising maximum phase poles.

2. A method according to claim 1, wherein for any output substream, the transfer function from both intermediate substreams have the same DC gain magnitude.

3. A method according to claim 1, wherein the step of filtering and matrixing comprises:

processing overlapping blocks of samples of the two intermediate streams;

discarding a final portion of each processed block of samples corresponding to an overlap with another block; and combining the remaining portions of each processed block of samples.

4. A method according to claim 1, wherein the two output substreams together contain the information required to allow the original quantised stream to be recovered exactly by a suitably initialised bandjoiner.

5. A method according to claim 1, wherein no two distinct input streams produce both the same output substreams and residual state in the filters.

6. A method according to claim 1, wherein the step of filtering and matrixing comprises:

filtering the two intermediate streams to produce two filtered intermediate streams; and matrixing the filtered intermediate streams to produce the two output substreams.

7. A method according to claim 6, wherein the matrixing is performed using a sum and difference matrix.

8. A method according to claim 1, wherein the output substreams are derived from the quantised signal by invertible linear processing with no further quantisation.

9. A method of joining two subband streams of quantised signal samples each having a subband sample rate, the method furnishing an output stream of quantised signal samples having twice the subband sample rate, the output stream having higher frequency components and lower frequency components represented by the two subband streams respectively, the method comprising the steps of:

matrixing and filtering the two subband streams to provide two quantised intermediate substreams; and, interleaving the two quantised intermediate to furnish the output stream, such that the intermediate substreams are respectively the even and odd samples of the output stream, wherein each intermediate substream is related to each subband stream by a respective transfer function that is infinite impulse response 'IIR' comprising maximum phase zeros; and wherein the step of matrixing and filtering incorporates quantisation configured to ensure that the output stream contains the information required to allow the quantised signal samples of each subband stream to be recovered exactly by a suitably initialised bandsplitter.

10. A method according to claim 9, wherein for any subband stream, the transfer function to both intermediate streams has the same DC gain magnitude.

11. A method according to claim 9, wherein the step of matrixing and filtering the two subband streams comprises:

matrixing the two subband streams to produce two matrixed substreams; and, filtering the two matrixed substreams with two different quantised filters respectively to produce the two quantised intermediate substreams.

12. A method according to claim 11, wherein the step of matrixing incorporates quantisation.

13. A method according to claim 11, wherein the step of filtering incorporates quantisation performed by a vector quantiser jointly quantising across the two filters.

14. A method according to claims 9, wherein all of the four transfer functions from each of the two subband streams to each of the two intermediate substreams are allpass.

15. A method according to claim 14, wherein the a first allpass response has coefficients of 1.0 and within $2^{-15}$ of 0.527864045 and a second allpass response has coefficients of 1.0 and within $2^{-15}$ of 0.105572809.

16. A method according to claim 14, wherein a first allpass response has coefficients of 1.0, within $2^{-15}$ of 0.3644245374 and within $2^{-15}$ of 0.01036373471 and a second allpass response has coefficients of 1.0, within $2^{-15}$ of 0.8365625224 and within $2^{-15}$ of 0.09327361235.

17. A bandsplitter comprising:

an input adapted to receive an input stream of signal samples at a sample rate;

two outputs adapted to furnish two output streams, each output stream having half the sampling rate of the input stream;

a de-interleaving unit having an input and two outputs, wherein the input of the de-interleaving unit is coupled to the input of the bandsplitter, and wherein the outputs of the de-interleaving unit contain even-numbered and odd-numbered samples of the input stream respectively;

two allpass filters each having a first input and an output, wherein the first input of each allpass filter is coupled to a respective output of the de-interleaving unit; and a lossless sum-and-difference unit having two inputs and two outputs, wherein each of the inputs to the sum-and-difference unit is coupled to a respective one of the outputs of the two allpass filters, and wherein each of the outputs of the sum-and-difference unit is coupled to a respective one of the outputs of the bandsplitter, wherein each allpass filter is adapted to receive the samples of the input stream in reverse time order.

18. A bandsplitter according to claim 17, wherein each allpass filter has a second input adapted to receive feedback derived from the outputs of the sum-and-difference unit, the sum-and-difference unit thereby being integrated within the filter.

19. A bandsplitter according to claim 17, further comprising a quantiser, wherein each allpass filter is adapted to furnish an output sample equal to the quantised sum of a previously received sample of the input stream and a linear combination of previously furnished output samples and input samples received subsequently to said previously received input sample up to and including the current sample.

20. A bandsplitter according to claim 18, comprising also a quantiser, wherein each allpass filter is adapted to furnish an output sample equal to the quantised sum of a previously received sample of the input stream and a linear combination of feedback samples previously received by the second input of the allpass filter and samples of the input stream received subsequently to said previously received sample up to and including the current sample.

21. A bandsplitter according to claim 17 wherein one of the two filters is characterised by an infinite impulse response 'IIR' having coefficients 340/32768 and 11941/32768 and the other allpass filter is characterised by an IIR having coefficients 3056/32768 and 27412/32768.

22. A bandsplitter according to claim 17, further comprising:

a blocking unit having an input and an output; and, a combining unit having an input, wherein the blocking unit is adapted to;

receive a stream of samples presented to its input;

divide the stream into overlapping blocks of samples, where each block has a beginning and an end; and furnish the overlapping blocks at its output;

wherein the output of the blocking unit is coupled to the first inputs of the allpass filters:

wherein the allpass filters are adapted to process in reverse time order the samples within each overlapping block of samples and to furnish processed blocks of samples at their outputs;

wherein the outputs of the allpass filters are coupled to the input of the combining unit; and, wherein the combining unit is adapted to receive overlapping processed blocks of samples presented to its input, to discard from each processed block the overlapping portion from the end of processed block and to combine the remaining portions to furnish a continuous stream of processed samples.

23. A bandjoiner comprising:

two inputs adapted to receive a first and a second stream of input quantised signal samples;

an output adapted to furnish an output stream having a sampling rate twice that of each input stream;

a sum-and-difference unit having two inputs and two outputs configured respectively as a sum output and a difference output;

two allpass filters each having an first input and an output; and, an interleaving unit having two inputs and an output, wherein the inputs of the sum-and-difference unit are connected to the inputs of the bandjoiner;

wherein the first input of each of the two allpass filters is connected to, respectively, the sum output and the difference output of the sum-and-difference unit;

wherein the inputs of the interleaving unit are coupled to the outputs of the allpass filter; and, wherein the output of the interleaving unit is coupled to the output of the bandjoiner, wherein the bandjoiner is lossless.

24. A bandjoiner according to claim 23, wherein the sum-and-difference scales one of its inputs by a factor 2 before taking the sum and difference.

25. A bandjoiner according to claim 23, comprising also a quantiser wherein each allpass filter is adapted to furnish an output equal to a quantised sum of a sample previously received by the first input of the allpass filter and a linear combination of previously furnished output samples and input samples received subsequently to said previously received sample up to and including the current sample.

26. A bandjoiner according to claim 25, wherein the quantiser is a vector quantiser adapted to jointly quantise signals within both allpass filters.

27. A bandjoiner according to claim 23 comprising a vector quantiser having two inputs and two and two outputs, wherein the inputs of the vector quantiser are connected to the respective outputs of the two allpass filters;

wherein the outputs of the vector quantiser are connected to the outputs of the bandjoiner;

wherein each allpass filter has a second input adapted to receive feedback derived in dependence on the outputs of the vector quantiser.

28. A bandjoiner according to claim 27, wherein the bandjoiner comprises also a quantiser wherein each allpass filter is adapted to furnish an output equal to a quantised sum of a sample previously received by the first input of the allpass filter and a linear combination of previously furnished samples of the feedback and input samples received subsequently to said previously received sample up to and including the current sample.

29. A bandjoiner according to claim 23, wherein the bandjoiner is configured to process pairs of signals produced by a bandsplitter such that the output of the bandjoiner is a lossless replica of a stream of signal samples that was received by the bandsplitter.

30. A bandjoiner according to claim 23, wherein the allpass filter have state variables;

wherein, if the bandjoiner is operated twice to furnish a first output stream and a second output stream, with identical initialisation of the state variables but with a difference in the input streams received on the two occasions, then either there will be a difference between the first output stream and the second output stream or there will be a difference between the states of the filters after each operation.

31. A bandsplitter according to claims 23, wherein a first allpass filter is characterised by an IIR response having coefficients 340/32768 and 11941/32768 and a second allpass filter is characterised by an IIR response having coefficients 3056/32768 and 27412/32768.

* * * * *